US008665198B2

(12) United States Patent
Okada et al.

(10) Patent No.: US 8,665,198 B2
(45) Date of Patent: Mar. 4, 2014

(54) DISPLAY DRIVING APPARATUS FOR CHARGING A TARGET VOLTAGE WITHIN A SAMPLING PERIOD AND A METHOD THEREFOR

(75) Inventors: Yoshinori Okada, Oita (JP); Atsuhiro Miwata, Oita (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 854 days.

(21) Appl. No.: 12/327,044

(22) Filed: Dec. 3, 2008

(65) Prior Publication Data

US 2009/0146985 A1 Jun. 11, 2009

(30) Foreign Application Priority Data

Dec. 5, 2007 (JP) ..... 2007-314543

(51) Int. Cl.
*G09G 3/36* (2006.01)

(52) U.S. Cl.
USPC ..... 345/94; 345/211

(58) Field of Classification Search
USPC ..... 345/211–213, 94–95
See application file for complete search history.

(56) References Cited

U.S. PATENT DOCUMENTS

2006/0066548 A1* 3/2006 Yoneyama et al. ..... 345/89
2006/0291309 A1* 12/2006 Maki ..... 365/203
2007/0171169 A1 7/2007 Hirama
2008/0106318 A1 5/2008 Uchida
2008/0303809 A1* 12/2008 Lee ..... 345/215

* cited by examiner

*Primary Examiner* — Long D Pham
(74) *Attorney, Agent, or Firm* — Volentine & Whitt, PLLC

(57) ABSTRACT

A source driver includes a ladder circuit for outputting multilevel gradation voltages by resistance voltage division, a first decoder for selecting one gradation voltage corresponding to the inputted image data to output the selected gradation voltage, an external power supply for supplying multilevel pre-charging voltages, a second decoder for selecting one pre-charging voltage corresponding to the image data, an operational amplifier for outputting the driving voltage corresponding to the inputted gradation voltage to the source electrode, a pre-charging switch interconnected between the operational amplifier and second decoder, and a controller for controlling the pre-charging switch. The connection between the first decoder and operational amplifier is always kept during the whole sampling period including a pre-charging period, and the controller controls the pre-charging switch to be turned on during the pre-charging period and turned off after the pre-charging period has expired.

8 Claims, 6 Drawing Sheets

16
D[M−2]
D[M−1]
34
$48_M$
$48_{M-1}$
A
B
40
42
44
45
CONTROLLER
$50_N$
$50_{N-1}$
38
D[0]
D[1]
D[2]
$48_1$
$48_2$
$48_3$
$V_1$
$V_2$
$V_3$
$V_{2M-1}$
$V_{2M}$
30
32
VH
$PR_1$
$PR_{2N}$
VL
36
EXTERNAL
POWER SUPPLY

100
D[M-2]
D[M-1]
D[0] D[1] D[2]
34
38
32
30
36
40
42
45
CONTROLLER
44
46
A B
EXTERNAL POWER SUPPLY
VH
VL
PR1
PR2N
V1
V2
V3
V2M-1
V2M
48M
48M-1
48M
48M-1
48M-1
48M-1
48M-1
48M-1
50N
50N
50N-1
50N-1
50N-1
50N-1
48M-1
48M-1
48M-1
48M

PRIOR ART

DISPLAY DRIVING APPARATUS FOR CHARGING A TARGET VOLTAGE WITHIN A SAMPLING PERIOD AND A METHOD THEREFOR

BACKGROUND OF THE INVENTION

1. Field of the Invention

The present invention relates to a display driving apparatus, and more specifically to an apparatus for driving a visual display panel, such as a liquid crystal display (LCD) panel. The present invention also relates to a method of driving such a display panel.

2. Description of the Background Art

Conventionally, in a display driving apparatus, e.g. for driving a LCD panel of TFT (Thin-Film Transistor) type, switches are provided to pre-charge the pixel electrodes of the LCD panel to a required potential level by temporarily short-circuiting the pixel electrodes so that the gradation voltages applied to the pixel electrodes are charged and then discharged at high-speed to perform high-speed dot-inversion driving of the LCD panel. As such a display driving apparatus, various apparatuses have been proposed.

For instance, U.S. patent application publication No. US 2007/0171169 A1 to Hirama discloses a display driving apparatus, which is able to prevent inner heat generation by means of pre-charging done from the external power supply.

In the display driving apparatus disclosed in Hirama, an operational amplifier outputs gradation voltages corresponding to image data and the output voltages are pre-charged by the external power supply at predetermined timing, i.e. a charge-sharing manner is performed so that heat generation is suppressed.

Recently, image data tends to be generated with longer bit length as well as higher resolution/definition. For instance, a decoder used for generating image data comprises a ladder circuit composed of a plurality of resistors serially connected, the ladder circuit outputs a plurality of multilevel gradation voltages and then the decoder selects a required graduation voltage corresponding to the applied image data from the gradation voltages to supply the selected voltage to the operational amplifier. As such a decoder, a decoder composed of multistage-connected switching elements, such as MOS-FETs (Metal Oxide Semiconductor-Field Effect Transistors), is used. For instance, a tournament-like arranged decoder as disclosed in U.S. patent application publication No. US 2008/0106318 A1 to Uchida is used for above-mentioned display driving apparatuses. In such cases, the number of stages of the serially connected switch elements constituting a decoder increases as the number of bits of image data increases. Therefore, the ON-resistance value of a transistor for use in the switching element, such as MOS-FET, is increased.

Furthermore, in recent years, as multi-channelization has been developed, the number of required outputs from the source driver exceeds 500 channels and approaches 1,000 channels. For example, if image data consists of the same data on each channel, the same gradation voltages are supplied to all of the channels from a single ladder circuit. Therefore, when the decoder and the input gate of the operational amplifier required for all of the channels have the respective loads, there are problems that the outputs of the decoder are delayed and then the voltages cannot reach a target potential level during the sampling period.

Recently, as the higher speed displays have been developed, the shorter sampling period is required and hence the pre-charging period is shortened. However, when the number of switching stages of the decoder is increased and consequently the ON-resistance value thereof is also increased, it may be impossible to heighten the positive-going speed of the voltage in the decoder to the extent of the speed of pre-charging. In this case, after the pre-charging period has finished, the output voltage may be temporarily fallen. These therefore cause problems that the voltage does not reach the target potential level before the sampling period has finished.

SUMMARY OF THE INVENTION

It is an object of the present invention to provide a display driving apparatus and a display driving method that are capable of suppressing the gradual fall of the gradation voltage to be applied in case of the sampling period is short, thereby solving the above-described problems.

In accordance with the invention, a display driving apparatus comprises a drive voltage output circuit for outputting a driving voltage corresponding to a gradation voltage inputted to an input terminal to pixel electrodes of image pixels in a display panel, a gradation voltage output circuit for outputting a plurality of multilevel gradation voltages, a decoder connected to said drive voltage output circuit during a pre-charging period for setting a voltage of the input terminal to a predetermined pre-charging potential level for selecting one of the plurality of multilevel gradation voltages which corresponds to the inputted image data and supplying the selected gradation voltage to the input terminal, a pre-charging voltage supply circuit for outputting a pre-charging voltage to the input terminal to set a voltage of the input terminal to the predetermined pre-charging potential level, a pre-charging switch interconnected between the pre-charging voltage supply circuit and the input terminal, a controller for turning on the pre-charging switch during the pre-charging period and turning off the pre-charging switch after the pre-charging period has expired.

According to the display driving apparatus of the present invention, during the pre-charging period, the decoder is connected to the drive voltage output circuit to select one of the gradation voltages which correspond to the inputted image data and output the selected voltage to the input terminal of the drive voltage output circuit. Then, the controller controls the pre-charging switch located between the pre-charging voltage supply circuit and the input terminal to turn on the pre-charging switch during the pre-charging period and to turn off the pre-charging switch after the pre-charging period has expired. Therefore, since the decoder is also internally pre-charged, it is possible to prevent a potential level at the input terminal of the drive voltage output circuit from temporarily falling after the pre-charging period has expired and to let the potential level, i.e. a voltage on the input terminal, reach the target potential level within the sampling period, although the sampling period is shorter. The image pixels may be of liquid crystal.

In accordance with another aspect of the invention, there is a method for driving a display in a display driving apparatus. The apparatus comprises a drive voltage output circuit that outputs a driving voltage corresponding to a gradation voltage inputted to an input terminal to pixel electrodes of image pixels in a display panel, a gradation voltage output circuit that outputs a plurality of multilevel gradation voltages, a decoder which selects one of the plurality of multilevel gradation voltages which corresponds to the inputted image data and supplies the selected gradation voltage to the input terminal, a pre-charging voltage supply circuit that outputs the pre-charging voltage to the input terminal to set a voltage of the input terminal to the predetermined pre-charging potential level, and a pre-charging switch that is interconnected between the pre-charging voltage supply circuit and the input terminal. The method particularly comprises the step of turning on the pre-charging switch during the pre-charging period and outputting the gradation voltage from the decoder to supply the gradation voltage to the input terminal; and the step of turning off the pre-charging switch after the pre-charging period has expired.

According to the method for driving the display of the present invention, it is possible, during the pre-charging period, to turn on the pre-charging switch and output the gradation voltage from the decoder to supply the voltage to the input terminal, and, after the pre-charging period has expired, turn off the pre-charging switch. Therefore, since the decoder is also internally pre-charged, it is possible to prevent a potential level at the input terminal of the output means from temporarily falling after the pre-charging period has expired, and to let the potential level, i.e. a voltage at the input terminal, reach the target potential level within the sampling period, although the sampling period is shorter.

As described above, according to the present invention, the display driving apparatus has advantage that is capable of suppressing the gradual fall of the gradation voltage to be applied in case of the sampling period shorter.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
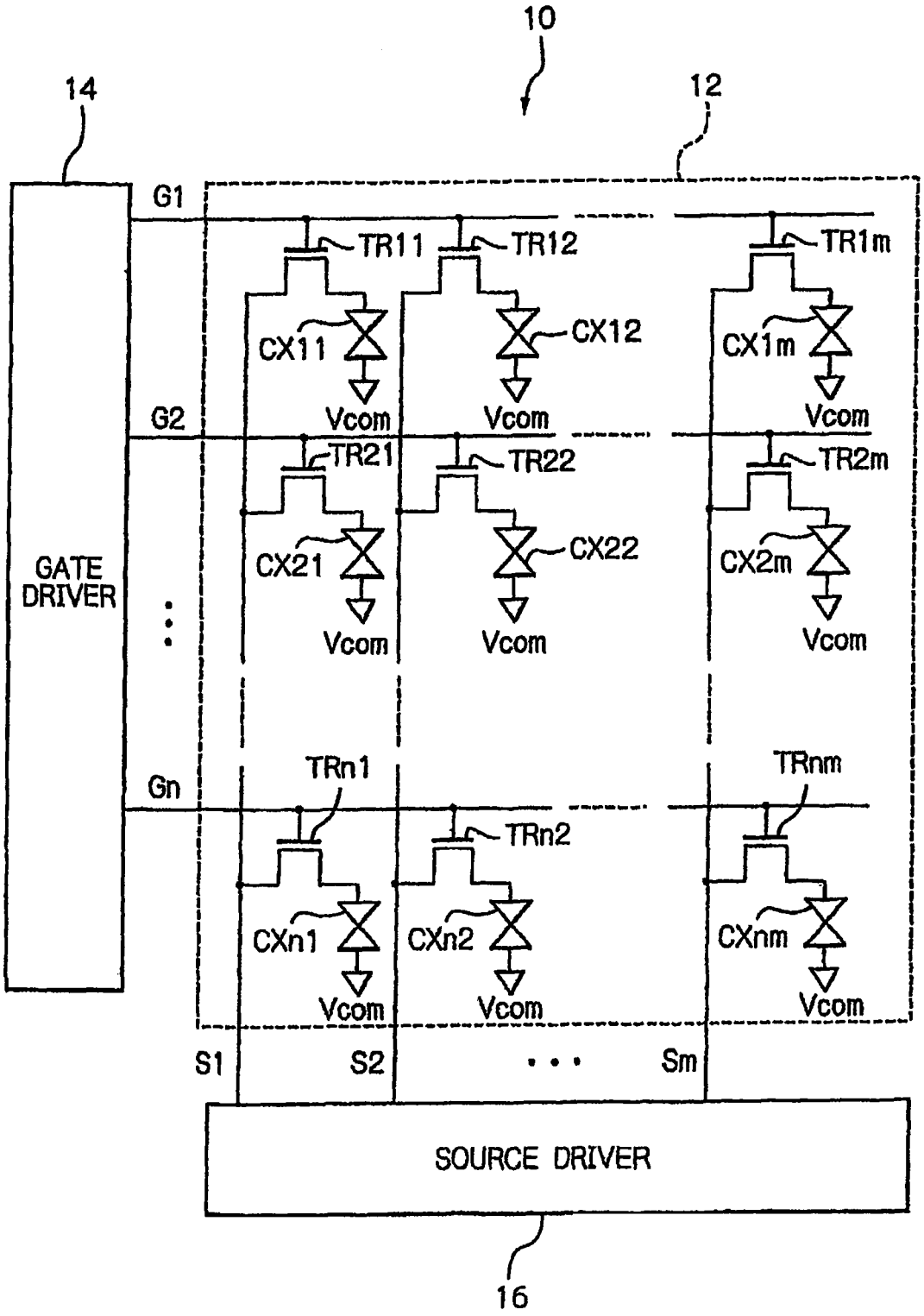
FIG. 1 is a schematic block diagram showing a preferred embodiment of an LCD apparatus in accordance with the present invention.

With reference to FIG. 1, a preferred embodiment of an LCD (Liquid Crystal Display) apparatus 10 according to the present invention will be described below. The LCD apparatus 10 comprises, for example, an LCD panel 12, such as a flat display panel, a gate driver 14 and a source driver 16, which are interconnected as illustrated.

In the LCD panel 12, gate lines G1-Gn and source lines S1 to Sm are arranged, where n represents the number of the gate lines and m represents the number of the source lines. The LCD panel 12 is driven by the gate driver 14 driving n gate lines G1 to Gn and the source driver 16 driving m source lines S1 to Sm.

The LCD panel 12 is configured by the liquid crystal pixels arranged in a substantially rectangular matrix, each of the pixels including a transistor and a liquid crystal capacitance, which substantially acts as a liquid crystal pixel. The LCD panel 12 thus comprises the switching transistors TR11 to TRnm, the liquid crystal capacitances CX11 to CXnm and a common electrode, not shown, which supplies a voltage level Vcom. In the embodiment, as the switching transistor, a thin-film transistor (TFT) is included. The present invention is, however, not restricted thereto.

The source driver 16 outputs the gradation voltages having the predetermined gradations corresponding in number to the bits of image data to the respective source lines S1 to Sm. For instance, in case that the bit length of the image data is M bit, the number of the gradations is $2^M$, where M is a natural number.

When the LCD panel 12 displays a desired image, the gate driver 14 sets the levels of the gate lines "high", sequentially from the gate line G1 to the gate line Gn. In synchronism with this setting, the source driver 16 generates the required gradation voltages corresponding to the image on the row of which the gate line level is "high" to supply the gradation voltages sequentially to the source lines S1 to Sm in this order, thereby sequentially charging the liquid crystal capacitances on each row, thus displaying the image on the LCD panel 12.

Figure 2:
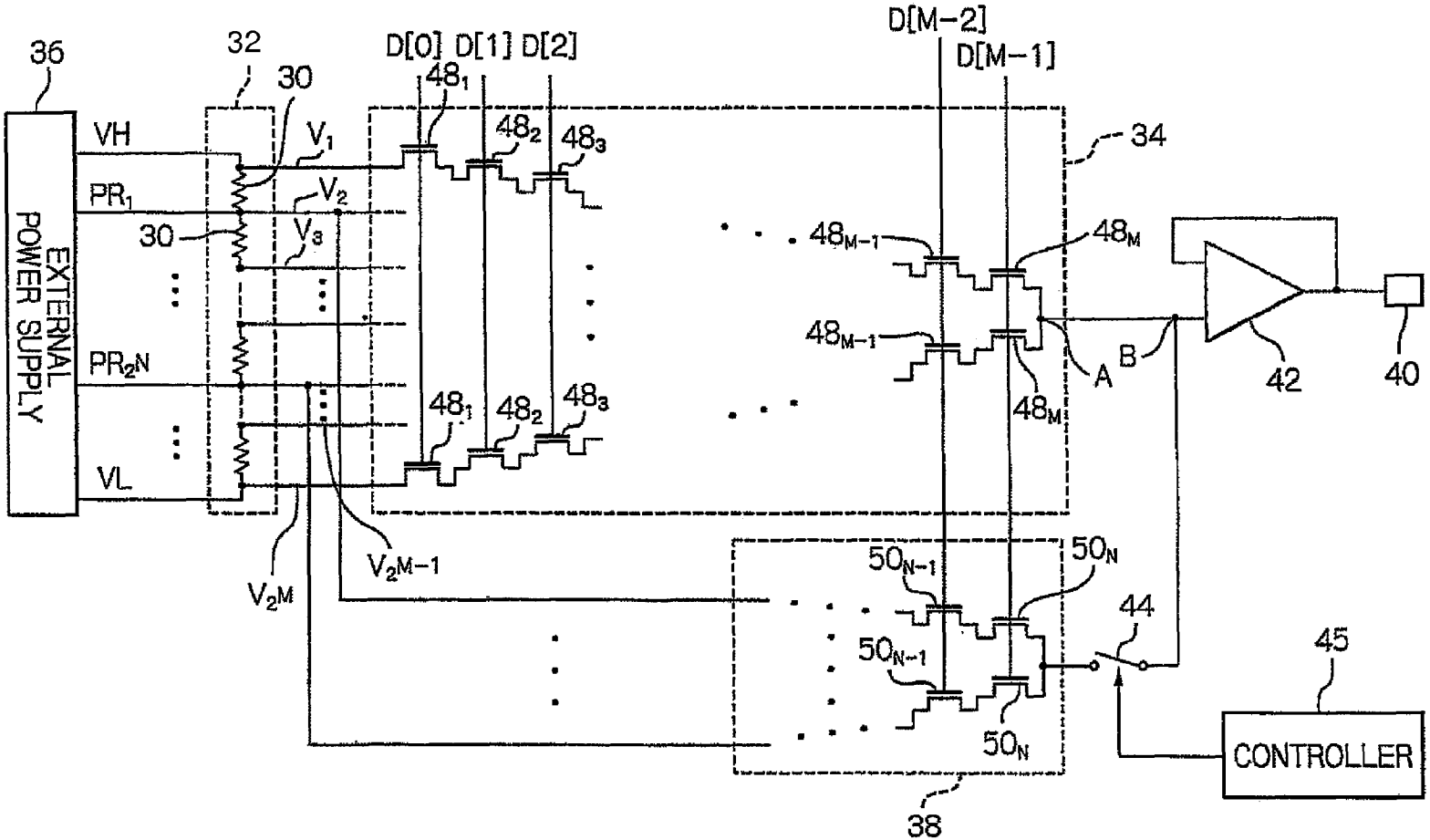
FIG. 2 is a schematic block diagram showing the source driver in the illustrative embodiment shown in FIG. 1.

FIG. 2 is a partly simplified schematic block diagram of the source driver 16 according to the illustrative embodiment shown in FIG. 1. In the figure, only a part related to one channel, i.e. one of the source lines is shown for simplification.

As shown in FIG. 2, the source driver 12 comprises a ladder circuit 32, a first decoder 34, an external power supply 36, a second decoder 38, an operational amplifier 42, a pre-charging switch 44 and a controller 45, which are interconnected as depicted. The ladder circuit 32 consists of a plurality of resistors 30 serially connected with each other and outputs multilevel gradation voltages by means of resistance voltage division. The first decoder 34 selects the gradation voltage corresponding to inputted image data from the multilevel voltages produced by the ladder circuit 32 and outputs a selected gradation voltage. The external power supply 36 supplies the highest voltage VH and the lowest voltage VL for defining the voltage division range of the ladder circuit 32 and plural levels of pre-charging voltage. The second decoder 38 selects the pre-charging voltage corresponding to the image data from the pre-charging voltages supplied from the external power supply 36. The operational amplifier 42 outputs the driving voltage corresponding to the gradation voltage inputted to its input terminal to a source electrode 40. The pre-charging switch 44 is interconnected between the operational amplifier 42 and the second decoder 38. The controller 45 controls turning on and off of the pre-charging switch 44. The above-described components are provided for each channel except the ladder circuit 32 and the external power supply 36.

The first decoder 34 and the second decoder 38 are constructed, for example, so that MOS-FETs (Metal Oxide Semiconductor-Field Effect Transistors) are arranged like a tournament in order. The first decoder 34 includes inverter circuits, not shown, and groups $\mathbf{48}_1$ to $\mathbf{48}_M$ of MOS-FETs of which the number of stages is equal to the number of the bits (M bits) of the image data. The second decoder 38 also includes inverter circuits, not shown, and groups $\mathbf{50}_1$ to $\mathbf{50}_N$ of MOS-FETs of which the number of stages equals to the number of the more significant bits (N bits) of the image data.

The MOS-FETs included in the first decoder 34 and the second decoder 38 may be composed of either n-channel MOS-FETs only or p-channel MOS-FETs only. However, in an application where the decoder comprising only n-channel MOS-FETs or only p-channel MOS-FETs is not able to cover the whole range of the gradation voltages outputted from the ladder circuit 32, it is possible to use CMOS-FETs (Complementary Metal Oxide Semiconductor-Field Effect Transistors).

The ladder circuit 32 supplies $2^M$ levels of gradation voltage $V_1$ to $V_{2^M}$ to the first stage MOS-FET group $\mathbf{48}_1$ of the first decoder 34. In addition, the external power supply 36 supplies the pre-charging voltages of which is equal in number to the stages of the MOS-FET groups included in the second decoder 38, i.e. $2^N$ levels of pre-charging voltage $PR_1$ to $PR_{2^N}$, to the first stage MOS-FET group of the second decoder 38 via the ladder circuit 32, as shown in FIG. 2.

The tournament-like arranged decoder may be, for example, of the type of decoder shown in FIG. 15 of Uchida stated earlier, wherein MOS-FET switching transistors are tournament-like arranged. In the first decoder 34 as shown in FIG. 2, for example, the MOS-FET group $\mathbf{48}_1$ having $2^M$ MOS-FETs is arranged as the first stage, the MOS-FET group $\mathbf{48}_2$ having $2^{M-1}$ MOS-FETs is arranged as the second stage and the following stages are arranged similarly, namely, the respective MOS-FET groups having half of MOS-FETs included in preceding group is consecutively arranged until the tenth stage. Thus, the MOS-FET switches of each stage are turned on depending upon corresponding one of the bits, D [0] to D [M−1], of the image data, and then, one signal path of the MOS-FETs is decided, which turns on the stages from the first to the Mth stage. In other words, as the same as winning a tournament, one gradation voltage corresponding to the image data is selected from the $2^M$ levels of gradation voltage $V_1$ to $V_{2^M}$ outputted from the ladder circuit 32 and outputted to the operational amplifier 42.

In the second decoder 38, the MOS-FET group having $2^N$ MOS-FETs is arranged as the first stage, the MOS-FET group having $2^{N-1}$ MOS-FETs is arranged as the second stage and the following stages are arranged similarly, i.e. the respective MOS-FET groups having half of MOS-FETs included in preceding group is consecutively arranged until the Nth stage. Thus, the MOS-FET switches of each stage are turned on depending upon corresponding one of N more significant bits of the image data, and then, one signal path of the MOS-FETs is decided, which turns on the stages from the first to the Nth stage. In other words, one pre-charging voltage corresponding to the image data is selected from 16 levels of pre-charging voltage $PR_1$ to $PR_{2^N}$ supplied from the external power supply 36 via the ladder circuit 32.

As described above, since the second decoder 38 selects the pre-charging voltage corresponding to the N more significant bits of the image data, the pre-charging voltage may be selected which is close to the gradation voltage corresponding to the image data.

In the source driver 16 configured as described above, when, as shown in FIG. 3, the desired gradation voltage is applied on the liquid crystal pixels in a sampling period 102 from time tA to time tC, during the pre-charging period 104 from time tA to time tB, the pre-charging voltage outputted from the second decoder 38 is applied to the point or node B, FIG. 2, between the first decoder 34 and the operational amplifier 42 by turning the pre-charging switch 44 on controlled by the controller 45 in order to set the potential level at the point A to be the pre-charging voltage. After the pre-charging period 104 expires, during the remaining period 106 from time tB to time tC, the pre-charging switch 44 is turned off.

As shown in FIG. 2, in the source driver 16, the connection between the first decoder 34 and the operational amplifier 42 is always kept, so the first decoder 34 can supply the gradation voltage selected in correspondence with the image data to the operational amplifier 42 during both the pre-charging period 104 and the remaining period 106.

The pre-charging switch 44 is adapted to turn on during the pre-charging period 104 and turn off during the remaining period 106 after the pre-charging period 104.

Figure 3:
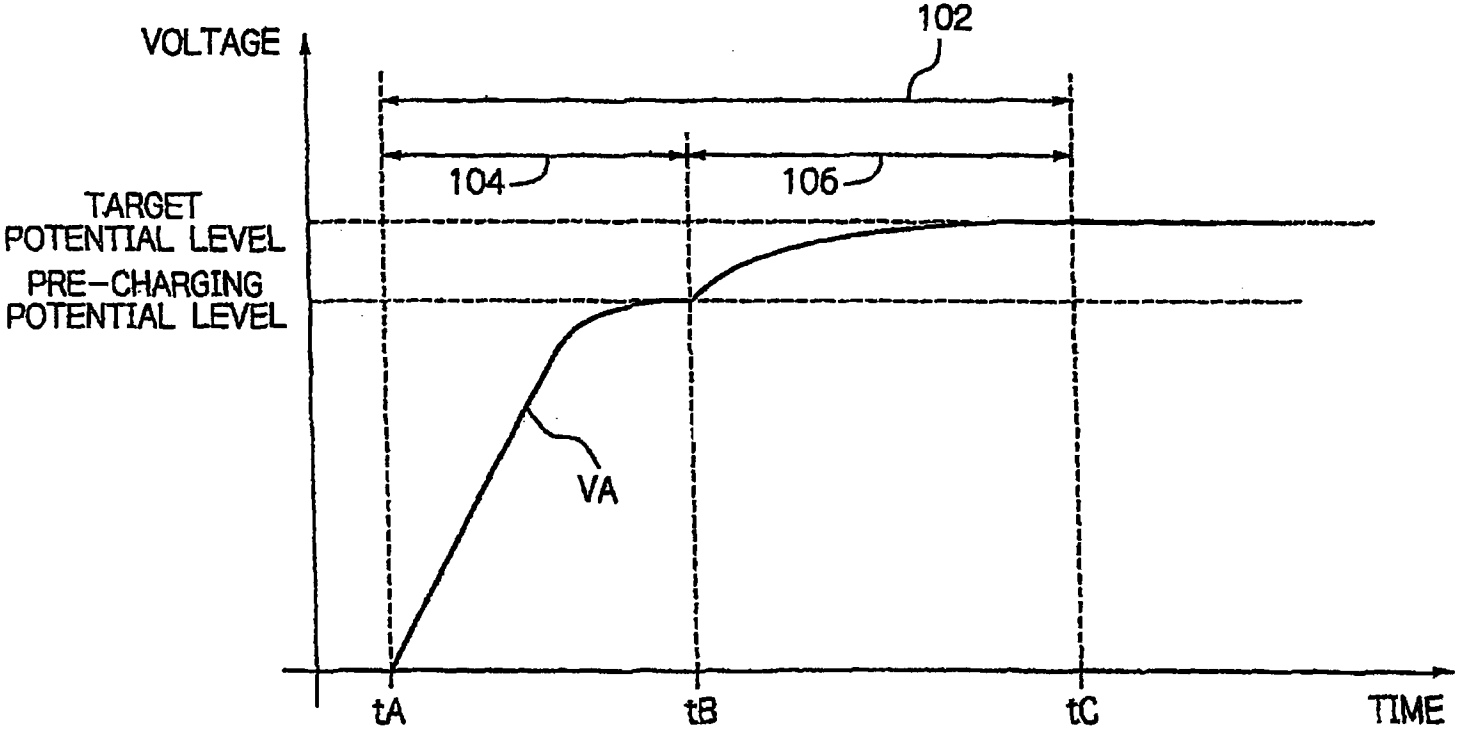
FIG. 3 is a graph plotting a curve showing the voltage outputted from a decoder in the source driver of the illustrative embodiment.

Thus, in the source driver 16 according to the illustrative embodiment, the first decoder 34 is always connected with the operational amplifier 42 during the pre-charging period 104. That causes the first decoder 34 to be internally pre-charged so that it is possible to charge the potential level at the point A of contact with the end of the MOS-FET groups in FIG. 2 close to the target potential level. Therefore, as shown in FIG. 3, the potential level at point A in FIG. 2 is able to sufficiently reach the target potential level by the time tC at which the sampling period 102 expires, without causing temporary voltage fall after the time tB at which the pre-charging period 104 expires.

Figure 5:
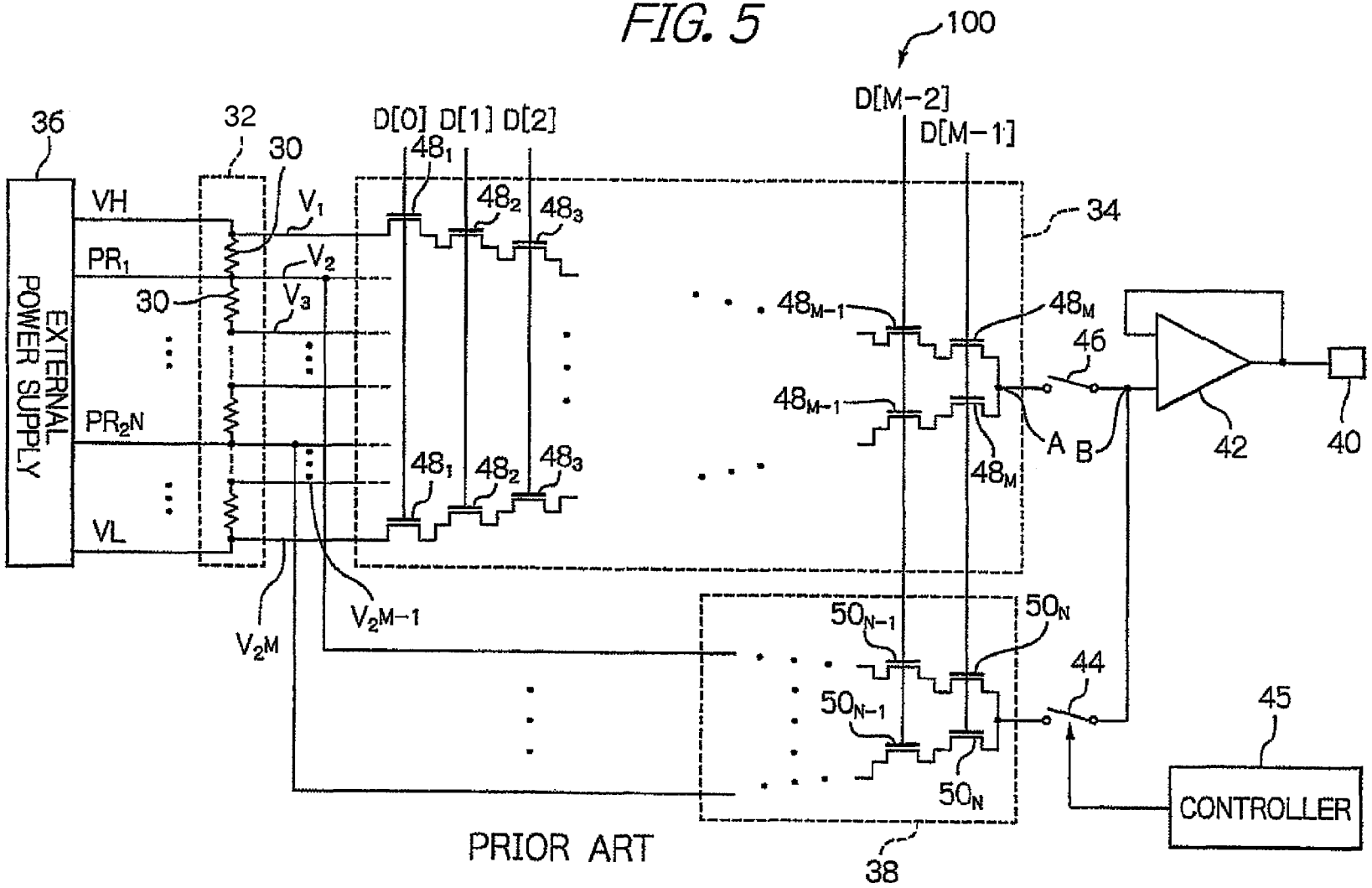
FIG. 5 is a schematic block diagram showing a conventional source driver taken for comparison with the present invention.

With reference to FIG. 5, a conventional source driver 100 will be described for comparison. The source driver 100 comprises a connecting switch 46 interconnected between the first decoder 34 and the operational amplifier 42 so that the controller 45 controls to turn on and off the pre-charging switch 44 and the connecting switch 46 as following. Like components are designated with the same reference numerals simply for facilitating the understanding of the invention.

TABLE 1

| | tA-tB | tB-tC |
|---|---|---|
| Connecting switch | OFF | ON |
| Pre-charging switch | ON | OFF |

Figure 6:
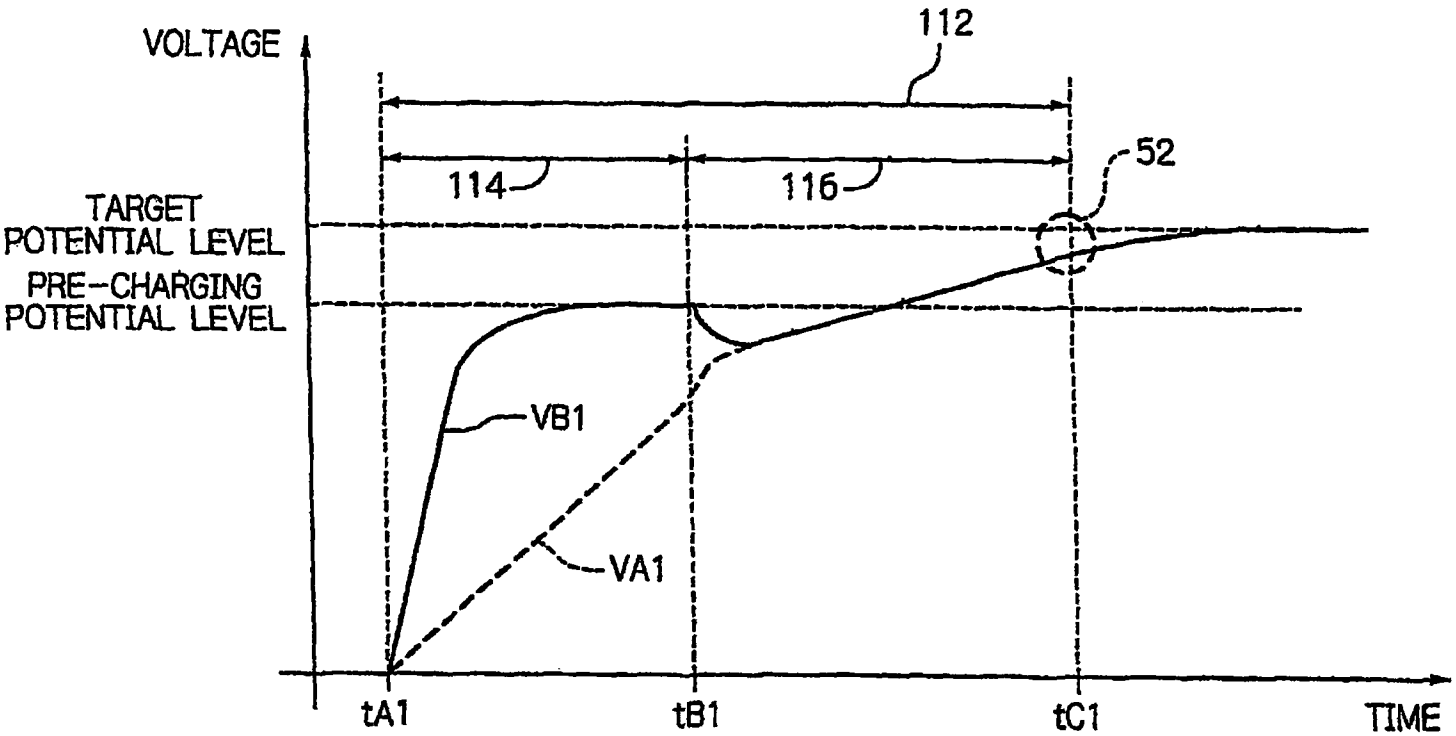
FIG. 6 is a graph plotting a curve showing the voltage outputted from a decoder in the conventional source driver shown in FIG. 5.

Table 1 lists an example of the states of the pre-charging switch 44 and the connecting switch 46 in the conventional source driver 100. In this case, as shown in FIG. 6, during a pre-charging period 114 from time tA1 to time tB1, the controller 45 turns off the connecting switch 46 and turns on the pre-charging switch 44 so that the second decoder 38 supplies the pre-charging voltage to the operational amplifier 42. Then, after the pre-charging period 114 has expired, during the remaining period 116 from time tB1 to tC1, in order to set the potential level at the point A shown in FIG. 5 to be the target potential level in FIG. 6, the controller 45 turns on the connecting switch 46 and turns off the pre-charging switch 44 so that the first decoder 34 supplies the gradation voltage to the operational amplifier 42.

However, when the pre-charging switch 44 and the connecting switch 46 are alternately turned on depending upon the pre-charging period 114 or the remaining period 116, the potential level VB1 of the point B shown in FIG. 5 between the connecting switch 46 and the operational amplifier 42 can reach the pre-charging potential level within the pre-charging period 114. On the other hand, the potential level VA1 of the point A shown in FIG. 5 between the connecting switch 46 and the first decoder 34 gradually goes positive, but does not reach the pre-charging potential level 4 before the pre-charging period 114 expires. Therefore, after the pre-charging period 114 has expired, the connecting switch 46, when turned on, may cause the output voltage of the first decoder 34 to temporarily fall without reaching the target potential level by the time tC1 at which the sampling period 112 expires, as shown in the dotted circle in FIG. 6. As a result, the voltage lower than the required gradation voltage may be applied to the source electrode 40, thereby causing deterioration on the displayed image.

More specifically, in an application in which the first decoder 34 does not include so many stages of the MOS-FET groups, the pre-charging switch 44 and the connecting switch 46 are alternately turned on depending upon the pre-charging period 114 or the remaining period 116 in the fashion listed on Table 1 so that it is possible to make the potential level VA1 reach the target potential level, although charging of the first decoder 34 by the gradation voltage supplied from the ladder circuit 32 and charging of the input terminal of the operational amplifier 42 by the pre-charging voltage are separately carried out from each other. By contrast, in an application where the first decoder 34 includes so many stages of the MOS-FET groups, as to increase the total ON-resistance of the signal path, the pre-charging switch 44 and the connecting switch 46, when controlled in the manner listed on Table 1, would sometimes cause the potential level VA1 not to reach the target potential level.

On the contrary, in the present alternative embodiment, the connection between the first decoder 34 and the operational amplifier 42 is always kept during and after the pre-charging period 104 as described above. That makes it possible to prevent the gradation voltage from falling even when the sampling period 102 is shorter.

In the illustrative embodiment described above, the connection between the first decoder 34 and the operational amplifier 42 is always kept. However, the source driver 16 of the embodiment may be structured to be provided with a connecting switch like the switch 46 included in the source driver 100. In the latter case, the connecting switch 46 may be controlled to be turned on during both the pre-charging period 104 and the remaining period 106, i.e. during the whole sampling period 102. When intentionally providing such a connecting switch 46, the control may be executed such that, if the sampling period 102 is relatively longer, it is then possible to control the connecting switch 46 to be turned off during the pre-charging period 104 for separating the decoder 34 from the operational amplifier 42 and for pre-charging only the input terminal of the operational amplifier 42 as in the conventional example, whereas, if the sampling period 102 is shorter, it is then possible to control the connecting switch 46 to be always turned on as in the embodiment described earlier. Therefore, even when the source driver 16 contains the connecting switch 46, such flexible control depending on the length of sampling periods 102 can be realized.

In the configuration provided with the connecting switch 46, if the first decoder 34 does not include so many stages of MOS-FET groups, i.e. the total ON-resistance of the path is not so higher, part of the pre-charging period 104 is often sufficient in order to turn on the connecting switch 46 rather than the whole pre-charging period 104. Therefore, the controller 45 may be adapted to define, in accordance with the size and number of the stages of MOS-FET groups included in the first decoder 34, a suitable part of the pre-charging period 104 in which the connecting switch 46 is turned on. Thus, it is possible to prevent the period required for turning on the connecting switch 46 from unnecessarily increasing.

Now, an alternative embodiment of the present invention will be described with reference to FIG. 4, which is a partly simplified schematic block diagram of a source driver 60 according to the alternative embodiment. In the description, similar components to the embodiment described earlier are designated with the same reference numerals, and no redundant description is repeated.

Figure 4:
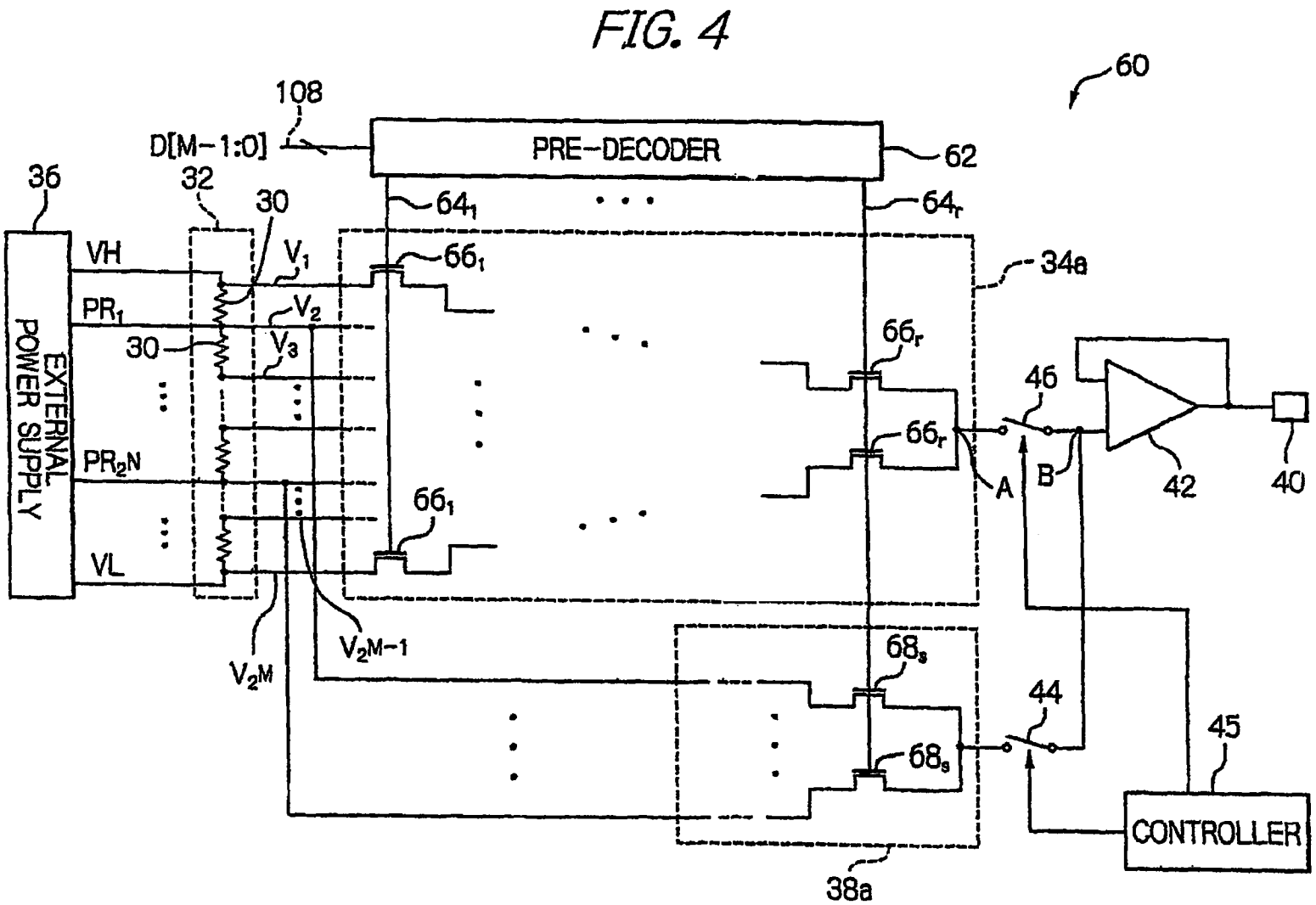
FIG. 4 is a schematic block diagram showing an alternative embodiment of the source driver in accordance with the present invention.

As seen from FIG. 4, the soured driver 60 comprises a pre-decoder 62, which is adapted to receive the M bits of image data 108, namely D [0] to D [M−1]. The pre-decoder 62 preliminarily decodes the inputted image data 108 every q bits to convert them into a $2^q$-level signal, which is outputted to the first decoder 34*a*, where q is a natural number equal to or smaller than the number M.

More specifically, when q is equal to 2, for example, the pre-decoder 62 decodes first two bits, D [0] and D [1]. In case that a code represented by the first two bits, D [0] and D [1], is '00', the pre-decoder 62 sends a predetermined first signal over a signal line $\mathbf{64}_1$. In case that the code is '01', the pre-decoder 62 sends a predetermined second signal over a signal line $\mathbf{64}_2$. In case that the code is '10', the pre-decoder 62 sends a predetermined third signal over a signal line $\mathbf{64}_3$. In case that the code is '11', the pre-decoder 62 sends a predetermined fourth signal over a signal line $\mathbf{64}_4$. The pre-decoder 62 thus decodes the inputted image data 108 for every two bits in order, and finally sends a predetermined signal corresponding to the decoded result of two bits, D [M−2]and D [M−1], on a signal line $\mathbf{64}_r$, wherein r=M/q.

The first decoder 34*a* comprises inverter circuits, not shown, and MOS-FET groups $\mathbf{66}_1$ to $\mathbf{66}_r$ which are respectively arranged for stages corresponding to the signal lines $\mathbf{64}_1$ to $\mathbf{64}_r$ in order. The MOS-FET groups are also arranged so that the MOS-FETs are arranged like a tournament in order. That is to say, in case of q=2, the first MOS-FET group $\mathbf{66}_1$ includes $2^M$ MOS-FETs and is connected with the signal line $\mathbf{64}_1$ at the first stage. After this group, the respective MOS-FET groups include the MOS-FETs of which the number is $1/2^q$ of the number of MOS-FETs included in a preceding stage, and are consecutively arranged in order until the last rth stage.

In the first decoder 34*a*, the MOS-FET switches of each stage are turned on in accordance with the signal level supplied from corresponding one of the signal lines $\mathbf{64}_1$ to $\mathbf{64}_r$. Thus, one signal path of the MOS-FETs is decided, which turns on from the first stage to the rth stage. In other words, as the same as winning a tournament, one gradation voltage corresponding to the image data is selected from the 1024 levels of gradation voltage $V_1$ to $V_{2^M}$ outputted from the ladder circuit 32, and outputted to the operational amplifier 42.

In addition, the second decoder 38a includes inverter circuits, not shown, and MOS-FET groups, e.g. including groups $\mathbf{68}_s$ and $\mathbf{68}_{s-}$, which are respectively arranged for the signal lines supplying the signals corresponding to the pre-decoded more significant N bits of the image data, wherein s $=N/_q$. The MOS-FET groups are also arranged so that the MOS-FETs are arranged like a tournament in order. That is to say, the first MOS-FET group $\mathbf{68}_1$ includes the MOS-FETs of which the number is equal to $\mathbf{2}^N$,and after this group, the respective MOS-FET groups include the MOS-FETs of which the number is $1/2^q$ of the number of MOS-FETs included in the preceding stage, and are consecutively arranged in order until the last sth stage. For instance, the case of N =4 and q=2 results in s=2 , so that the first MOS-FET group includes sixteen MOS-FETs and the second MOS-FET group includes four MOS-FETs.

In the second decoder 38a, the MOS-FET switches of each stage are turned on in accordance with the signal level supplied from corresponding one of the signal lines, such as lines $\mathbf{64}_r$ to $\mathbf{64}_{r-1}$. Thus, one signal path of the MOS-FETs is decided, which turns on from the first to the second stage. In other words, one pre-charging voltage corresponding to the image data is selected from the 16 levels of pre-charging voltage $PR_1$ to $PR_{2^N}$ supplied from the external power supply 36 via the ladder circuit 32, and outputted to the operational amplifier 42.

Moreover, the controller 45 controls to turn on and off the connecting switch 46 and the pre-charging switch 44 as following.

TABLE 2

| | tA-tB | tB-tC |
|---|---|---|
| Connecting switch | ON | ON |
| Pre-charging switch | ON | OFF |

Table 2 lists a further example of the states of the pre-charging switch 44 and the connecting switch 46 in the alternative embodiment. In this case, as shown in FIG. 3, during the pre-charging period 104 from time tA to time tB, both of the connecting switch 46 and the pre-charging switch 44 are turned on. Then, in order to connect the first decoder 34*a* to the operational amplifier 42 after the pre-charging period 104 has expired during the remaining period 106 from time tB to time tC, i.e. during the whole sampling period 102 from time tA to time tC, while the connecting switch 46 is kept turned on, the pre-charging switch 44 is turned off. That is to say, the pre-charging switch 44 is controlled as the same as the illustrative embodiment shown in and described with reference FIG. 2.

By controlling the connecting switch 46 and the pre-charging switch 44 in the manner described above, like the illustrative embodiment shown in FIG. 2, the potential level at point A shown in FIG. 4 is able to sufficiently reach the target potential level by the time tC at which the sampling period 102 expires, without causing temporary voltage fall after the time tB at which the pre-charging period 104 expires.

Furthermore, in the alternative embodiment, by reducing in number the stages of the MOS-FET groups in the first decoder 34*a* and the second decoder 38*a*, it is possible to shorten the time required for getting the target potential, even when the sampling period 102 is shorter.

Besides, in an application where the first decoder 34*a* does not include so many MOS-FET groups so that the total ON-resistance of the path is not high, part of the pre-charging period 104 is often sufficient to turn on the connecting switch 46 rather than the whole pre-charging period 104. Therefore, the controller 45 may decide, in accordance with the size and number of stages of MOS-FET groups included in the first decoder 34*a*, the suitable length of period wherein the connecting switch 46 is turned on during the pre-charging period 104. Thus, it is possible to prevent the period required for turning on the connecting switch 46 from unnecessarily increasing.

The source driver 60 in the alternative embodiment may be constructed so that the connection between the first decoder 34*a* and the operational amplifier 42 is always kept without providing a switch corresponding to the connecting switch 46, like the illustrative embodiment shown in FIG. 2.

In the alternative embodiment, the pre-decoder 62 is provided to preliminarily decode M bits of image signal every q bits into $2^q$ levels of signal. It may however be suitably designed how many bits are processed by a single pre-decoding and how many target signal levels input data are pre-decoded, e.g. in accordance with the length of sampling period.

Moreover, in the illustrative embodiments described above, the pre-charging voltage is selected on the basis of N more significant bits of image data. It may however be suitably designed which bits of image data are used for selecting the pre-charging voltage.

Furthermore, in the illustrative embodiments described above, the pre-charging voltage is supplied from the external power supply 36 via ladder circuit 32. It is however possible to provide another power supply dedicated for supplying the pre-charging voltage.

In addition, in the illustrative embodiments described above, the decoder is constructed so that the MOS-FETs are arranged like a tournament. The decoder is however not restricted by the specific structure, but may be adapted to select the gradation voltage corresponding to the image data. It may be, for instance, of the pre-decoding type included in the alternative embodiment or a ROM (Read-Only Memory) decoding type.

Moreover, in the illustrative embodiments described above, those decoders utilize MOS-FETs as the switches. The decoder is not restricted by the specific types switching devices, but may be adapted to utilize other types of switching devices.

Furthermore, the illustrative embodiments described above may be provided with an adjusting circuit for adjusting the length of the pre-charging period. In this case, the adjusting circuit can control to turn off the pre-charging switch 44 and then to terminate the pre-charging period as soon as the output voltage of the decoder has reached the pre-charging potential level. It is therefore not necessary to wait for turning off of the pre-charging switch 44 until the pre-charging period has expired like a case where a fixed pre-charging period is used, thereby being able to shorten the sampling period.

In addition, the illustrative embodiments described above are implemented as an LCD driving apparatus. The present invention however is not restricted to such specific embodiments, but may be applied to other types of driving apparatus for driving multi-gradation image display panels wherein several levels of gradation voltage are applied to the display pixels, such as organic electro-luminescence (EL) display devices or organic light emitting diode display devices.

In accordance with an aspect of the invention, a method for driving a display in a display driving apparatus that comprises: a drive voltage output circuit that outputs a driving voltage corresponding to a gradation voltage inputted to an input terminal to pixel electrodes of image pixels in a display panel; a gradation voltage output circuit that outputs a plurality of multilevel gradation voltages; a decoder that selects one of the plurality of multilevel gradation voltages which corresponds to the inputted image data and that supplies the selected gradation voltage to the input terminal; a pre-charging voltage supply circuit that outputs the pre-charging voltage to the input terminal to set a voltage of the input terminal to the predetermined pre-charging potential level; and a pre-charging switch that is interconnected between said pre-charging voltage supply circuit and the input terminal, said method comprising the steps of: turning on said pre-charging switch during the pre-charging period and outputting the gradation voltage from said decoder to the input terminal; and turning off said pre-charging switch after the pre-charging period has expired.

In the method described above, said display driving apparatus further comprises a connecting switch for connecting said decoder with said output circuit, said method further comprising a step of turning on said connecting switch during the pre-charging period.

The entire disclosure of Japanese patent application No. 2007-314543 filed on Dec. 5, 2007, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A display driving apparatus comprising:

a drive voltage output circuit for outputting a driving voltage corresponding to a gradation voltage inputted to an input terminal to pixel electrodes of image pixels of a display panel;

a gradation voltage output circuit for outputting a plurality of multilevel gradation voltages;

a decoder directly connected to said drive voltage output circuit during a pre-charging period for setting a voltage of the input terminal to a predetermined pre-charging potential level for selecting one of the plurality of multilevel gradation voltages which corresponds to inputted image data and supplying the selected gradation voltage to the input terminal;

a pre-charging voltage supply circuit for outputting a pre-charging voltage to set a voltage of the input terminal to the predetermined pre-charging potential level;

a pre-charging switch interconnected between said pre-charging voltage supply circuit and the input terminal;

a controller for turning on said pre-charging switch during the pre-charging period and turning off the pre-charging switch after the pre-charging period has expired; and a connecting switch for directly connecting said decoder with said drive voltage output circuit, said controller turning on said connecting switch during the pre-charging period.

2. The display driving apparatus in accordance with claim 1, wherein said gradation voltage output circuit includes a ladder circuit that includes a plurality of resistors connected in series to each other and that outputs the plurality of multilevel gradation voltages.

3. The display driving apparatus in accordance with claim 1, wherein said pre-charging voltage supply circuit produces a plurality of multilevel pre-charging voltages, selects one of the plurality of multilevel pre-charging voltages which corresponds to the image data, and outputs the selected voltage.

4. The display driving apparatus in accordance with claim 3, wherein said pre-charging voltage supply circuit receives part of bit data of the image data and selects the pre-charging voltage on a basis of the inputted part of the bit data.

5. The display driving apparatus in accordance with claim 1, wherein said decoder comprises:

a pre-decoder which pre-decodes the image data for every plural bits; and a decoding circuit which selects one of the plurality of multilevel gradation voltages which corresponds to the pre-decoded signal and outputs the selected voltage to the input terminal.

6. The display driving apparatus in accordance with claim 5, wherein said decoding circuit has a plurality of MOS-FET (Metal Oxide Semiconductor-Field Effect Transistors) devices arranged in a tournament form.

7. The display driving apparatus in accordance with claim 1, wherein said decoder has a plurality of MOS-FET (Metal Oxide Semiconductor-Field Effect Transistors) devices arranged in a tournament form.

8. The display driving apparatus in accordance with claim 1, wherein the image pixels are of liquid crystal.

* * * * *